US008650986B2

(12) United States Patent
Yamamoto

(10) Patent No.: US 8,650,986 B2
(45) Date of Patent: Feb. 18, 2014

(54) VEHICLE OPERATION PEDAL

(75) Inventor: Akiyoshi Yamamoto, Toyota (JP)

(73) Assignee: Toyoda Iron Works Co., Ltd., Toyota-shi (JP)

( * ) Notice: Subject to any disclaimer, the term of this patent is extended or adjusted under 35 U.S.C. 154(b) by 250 days.

(21) Appl. No.: 12/955,362

(22) Filed: Nov. 29, 2010

(65) Prior Publication Data

US 2011/0132133 A1 Jun. 9, 2011

(30) Foreign Application Priority Data

Dec. 4, 2009 (JP) ..... 2009-276447

(51) Int. Cl.
*G05G 1/44* (2008.04)
*G05G 1/30* (2008.04)

(52) U.S. Cl.
CPC ..... *G05G 1/30* (2013.01)
USPC ..... 74/560; 74/512; 74/513; 74/514

(58) Field of Classification Search
USPC ..... 74/512–514, 560, 563, 562
See application file for complete search history.

(56) References Cited

U.S. PATENT DOCUMENTS

| | | | | |
|---|---|---|---|---|
| 5,690,000 | A * | 11/1997 | Terrel | 74/560 |
| 5,778,732 | A * | 7/1998 | Patzelt et al. | 74/512 |
| 6,513,407 | B1 * | 2/2003 | Higgins | 74/560 |
| 2010/0058887 | A1 * | 3/2010 | Fujita et al. | 74/512 |

FOREIGN PATENT DOCUMENTS

| | | | |
|---|---|---|---|
| JP | U-56-172120 | | 12/1981 |
| JP | U-06-075019 | | 10/1994 |
| JP | A-11-029015 | | 2/1999 |
| JP | A-2007-122610 | | 5/2007 |
| WO | WO 2008/120586 | * | 10/2008 |

OTHER PUBLICATIONS

Definition of "weld" from Merriam Websters online dictionary, obtained Jun. 4, 2013.*
European Search Report for corresponding European Patent Application No. 10193518.7, mailed on Apr. 13, 2011.
Jan. 22, 2013 Office Action issued in JP Application No. 2009-276447 (with partial English translation).
Nov. 5, 2013 Office Action issued in Chinese Patent Application No. 201010579193.2 (with translation).

* cited by examiner

*Primary Examiner* — Vinh Luong
*Assistant Examiner* — Brian McGovern
(74) *Attorney, Agent, or Firm* — Oliff PLC

(57) ABSTRACT

It is provided a vehicle operation pedal in which a pedal sheet is integrally fixed to a sheet fixed portion of a pedal arm in such a posture that a depressed face of the pedal sheet, which is depressed by a driver, faces a driver's seat, comprising a fitting hole through which the sheet fixed portion of the pedal arm extends formed in the pedal sheet; and the sheet fixed portion being fitted into the fitting hole from a rear face that is on the side opposite to the depressed face, and a peripheral portion around the fitting hole being integrally fixed to the sheet fixed portion by welding performed from the depressed face side.

2 Claims, 4 Drawing Sheets

VEHICLE OPERATION PEDAL

INCORPORATION BY REFERENCE

The disclosure of Japanese Patent Application No. 2009-276447 filed on Dec. 4, 2009 including the specification, drawings and abstract is incorporated herein by reference in its entirety.

BACKGROUND OF THE INVENTION

1. Field of the Invention

The invention relates generally to a vehicle operation pedal, and more specifically to improvements in a vehicle operation pedal in which a pedal sheet is integrally fixed to a sheet fixed portion of a pedal arm by welding.

2. Description of the Related Art

There is a vehicle operation pedal in which a pedal sheet is integrally fixed to a sheet fixed portion of a pedal arm in such a posture that a depressed face of the pedal sheet, which is depressed by a driver, faces a driver's seat. Such a vehicle operation pedal is frequently used as, for example, a brake pedal or an accelerator pedal. Japanese Patent Application Publication No. 2007-122610 (JP-A-2007-122610) describes an example of the above-described vehicle operation pedal. According to JP-A-2007-122610, a pedal arm is formed of a pair of halves having shapes obtained by dividing the pedal arm in the vehicle width direction, and peripheral portions of the pair of halves are integrally welded so that the pedal arm has a hollow structure. The pedal arm is arranged in a vehicle so as to be pivotable, at an upper end portion, about a predetermined support axis. Lower end portions of the pair of halves, to which the pedal sheet is fixed, extend apart from each other in the vehicle width direction so as to form a skirt shape, and the pair of halves are bent inward from distant end portions at substantially right angle to form sheet fixed portions. The pedal sheet is integrally fixed to the sheet fixed portions, for example, by welding.

However, the above-described existing vehicle operation pedal has the following problem. In this vehicle operation pedal, the sheet fixed portions are overlapped with a rear face of the pedal sheet and integrally fixed to the rear face, for example, by arc welding. Therefore, the presence of the pedal arm reduces the flexibility in handling of a welding device, for example, a welding torch, and limits welds. As a result, it is difficult to ensure a sufficient degree of depression rigidity of the pedal sheet.

SUMMARY OF THE INVENTION

The invention is made in the light of the above-described circumstances, and it is an object of the invention to increase the flexibility in handling of a welding device when a pedal sheet is welded to a sheet fixed portion of a pedal arm to easily achieve a high degree of depression rigidity of the pedal sheet.

To achieve the object, in the first aspect of the invention, characterized in that a vehicle operation pedal in which a pedal sheet is integrally fixed to a sheet fixed portion of a pedal arm in such a posture that a depressed face of the pedal sheet, which is depressed by a driver, faces a driver's seat, characterized in that a fitting hole through which the sheet fixed portion of the pedal arm extends is formed in the pedal sheet and the sheet fixed portion is fitted into the fitting hole from a rear face that is on the side opposite to the depressed face, and a peripheral portion around the fitting hole is integrally fixed to the sheet fixed portion by welding performed from the depressed face side.

In the second aspect of the invention, in a vehicle operation pedal recited in the first aspect of the invention, characterized in that (a) the pedal arm has a hollow structure and has a cross section in a polygonal shape, and an end opening portion of a lower end portion of the pedal arm is used as the sheet fixed portion; and (b) the end opening portion and the peripheral portion around the fitting hole are integrally fixed to each other by welding in such a manner that at least one of corner portions of the polygonal shape is included in a weld at which the end opening portion and the peripheral portion are welded to each other.

In the third aspect of the invention, in a vehicle operation pedal recited in the first or the second aspect of the invention, characterized in that (a) a tubular portion that extends at substantially right angle to the depressed face so as to be overlapped with an outer peripheral face of the sheet fixed portion and so as to be parallel to the outer peripheral face is formed in the peripheral portion around the fitting hole, and an edge of the tubular portion and an edge of the sheet fixed portion are made substantially flush with each other and integrally fixed to each other with edge weld; and (b) a groove and a flat portion are formed in the pedal sheet, the groove extends around and along an outer periphery of the tubular portion and is recessed toward the rear face side and the flat portion is contiguous with an outer peripheral-side side wall of the groove and extends toward an outer periphery of the pedal sheet are formed in the pedal sheet.

Advantageous Effects of Invention

In the vehicle operation pedal, the fitting hole, through which the sheet fixed portion of the pedal arm extends, is formed in the pedal sheet. In addition, the sheet fixed portion is fitted in the fitting hole from the rear face side, and then the peripheral portion around the fitting hole is integrally fixed to the sheet fixed portion of the pedal arm by welding performed from the depressed face side. Accordingly, there is no possibility that a welding device, for example, a welding torch and the pedal arm contact each other when the welding is performed, which increases the flexibility in handling of the welding device. As a result, it is possible to more easily achieve a predetermined degree of depression rigidity by appropriately setting the welds.

In the second aspect of the invention, the pedal arm has the hollow structure and has the cross section in a polygonal shape, and the end opening portion of the lower end portion of the pedal arm is used as the sheet fixed portion. In addition, the end opening portion and the peripheral portion around the fitting hole of the pedal sheet are integrally fixed to each other in such a manner that at least one of corner portions of the polygonal shape is included in the weld. Therefore, according to the second aspect of the invention, it is possible to easily achieve a high degree of depression rigidity due to the rigidity of the corner portion.

In the third aspect of the invention, the cylindrical portion is formed in the peripheral portion around the fitting hole, and the edge of the cylindrical portion and the edge of the sheet fixed portion of the pedal arm are substantially flush with each other, and are integrally fixed to each other with edge weld. Therefore, the flexibilities in handling of the welding device and setting the welds are made higher than those in, for example, fillet weld. In this case, the groove and the flat portion are formed in the pedal sheet. The groove is formed around and along an outer periphery of the tubular portion, and the flat portion is contiguous with the outer peripheral-side side wall of the groove and extends toward the outer periphery of the pedal sheet. Therefore, a bulge of the weld of, for example, the tubular portion is eliminated or reduced. As a result, it is possible to suppress deterioration of an operating feel felt by the driver who places his/her foot on the depressed face and depresses the depressed face. Further, the tubular portion that is extended at substantially right angle to the depressed face is formed. Due to the presence of the tubular portion, it is possible to easily fit the sheet fixed portion of the pedal arm into the fitting hole upon fitting from the rear face side of the pedal sheet. Further it is possible to reduce the amount of play between the pedal arm and the pedal sheet.

BRIEF DESCRIPTION OF THE DRAWINGS

The features, advantages, and technical and industrial significance of this invention will be described in the following detailed description of example embodiments of the invention with reference to the accompanying drawings, in which like numerals denote like elements, and wherein:

FIG. 1A is a left side view, FIG. 1B is an enlarged front view showing the structure near a pedal sheet viewed from the direction indicated by an arrow 113 in FIG. 1A, and FIG. 1C is a cross-sectional view taken along the line IC-IC in FIG. 1B;

FIGS. 4A and 48 are views showing a third embodiment of the invention, and correspond to FIGS. 1B and 1C, respectively.

DETAILED DESCRIPTION OF EMBODIMENTS

Figure 1B:
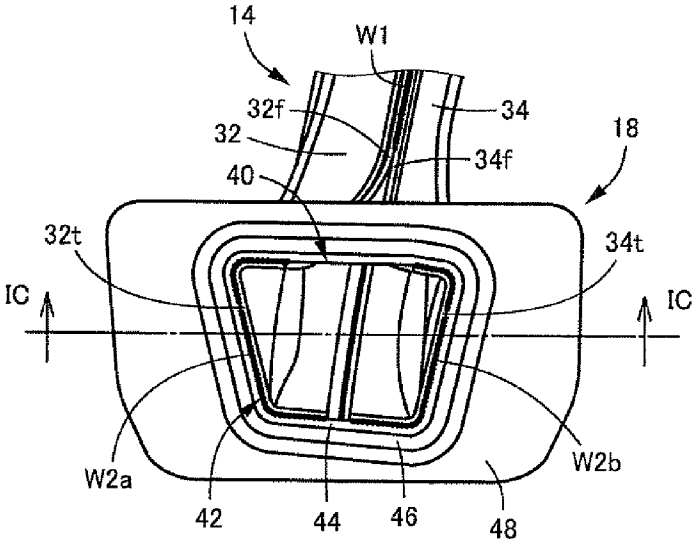
FIGS. 1A, 1B and 1C are views showing a vehicle brake pedal according to a first embodiment of the invention, where

The invention is suitably applied to, for example, a service brake pedal, a parking brake pedal, and an accelerator pedal. A pedal arm in the second aspect of the invention has a hollow structure and has a cross section in a polygonal shape. However, various forms may be adopted, for example, a plate-shaped pedal arm formed of a relatively thick plate, a column-shaped pedal arm that is bent in a predetermined shape or a rectangular column-shaped pedal arm that is bent in a predetermined shape may be employed. The pedal arm having the hollow structure is formed by putting a pair of halves, each having, for example, a hat-shaped cross section, together in such a posture that the halves face each other and in such a manner that flanges formed at their peripheries contact each other, and then integrally connecting the peripheries, for example, by welding. The pedal arm having the hollow structure need not be enclosed as a bag-shape, by joining the entire peripheries of the halves. Alternatively, there may be an opening between the peripheries of the halves. For example, a pedal arm having a hollow structure, which is formed, by bending one plate member or the like into a rectangular cylindrical shape and then integrally connecting the ends of the plate member to each other by welding or the like may be employed. When the end opening portion of the lower end portion of the pedal arm is used as the sheet fixed portion, the lower end portion to which the pedal sheet is fixed may be in a rectangular columnar shape having a substantially constant cross section, or may be in a skirt-shape (inverted tapered shape) having a cross section that increases toward the end of the pedal arm.

Preferably, the pedal arm in the second aspect of the invention has a quadrangular cross section, for example, a square cross section, a rectangular cross section or a trapezoidal cross section. Alternatively, the pedal arm in the second aspect of the invention may have, for example, a flat hexagonal cross section. Corner portions of a polygonal shape need not be angular, and may be smoothly curved in, for example, an arc-shape. In addition, side portions of a polygonal shape need not be completely flat, and may be curved. That is, the cross section of the pedal arm need not be in a geometric polygonal shape, such as a rectangular shape or a hexagon shape, as long as the cross section has a substantially polygonal shape so that corner portions and flat portions can be distinguished from each other as a whole. When the pedal sheet is welded with the pedal arm, at least one of the corner portions needs to be included in a weld. Preferably, the one corner portion to which the highest load is applied among all the corner portions when the brake pedal is depressed is included in the weld. More preferably, all the corner portions are included in the weld so that a high degree of rigidity is achieved. When the other inventions are implemented, a pedal arm having a hollow structure and having a circular or an ellipsoidal cross section may be employed.

The fitting hole which is formed in the pedal sheet and through which the sheet fixed portion of the pedal arm extends may be a single fitting hole of which a shape corresponds to the sheet fixed portion. Alternatively, the sheet fixed portion may be divided into multiple portions or multiple projections may be formed in the sheet fixed portion, multiple fitting holes may be formed in the pedal sheet, and the multiple portions of the sheet fixed portion or the multiple projections may be fitted in the respective fitting holes. The shapes of the fitting holes are appropriately set based on the shapes of the sheet fixed portions, and at least a portion of the peripheral portion around each fitting hole is fixed to the corresponding sheet fixed portion by welding. When the sheet fixed portion of the pedal arm is fitted in the single fitting hole, the peripheral portion around the fitting hole may be welded at its entire circumference to the entire circumference of the sheet fixed portion. As the sheet fixed portion of the pedal arm, for example, the end portion of the lower end portion of the pedal arm that is bent toward the driver's seat is suitably used. However, various forms may be adopted, for example, the sheet fixed portion may be formed at, for example, an intermediate portion of the pedal arm.

In the third aspect of the invention, the tubular portion is formed in the peripheral portion around the fitting hole, and the edge of the tubular portion and the edge of the sheet fixed portion of the pedal arm are made substantially flush with each other and integrally connected to each other with edge weld. However, various forms may be adopted. For example, the peripheral portion around the fitting hole of the pedal sheet may contact the sheet fixed portion of the pedal arm at substantially right angle and the sheet fixed portion and the peripheral portion may be integrally fixed to each other with fillet weld or the like without forming the cylindrical portion. Alternatively, a bent portion that is bent at substantially right angle may be formed only at a portion that is welded to the sheet fixed portion, and the bent portion and the sheet fixed portion may be integrally fixed to each other with edge weld. The edge of the sheet fixed portion of the pedal arm and the depressed face of the pedal sheet may be made substantially flush with each other, and welded to each other.

Preferably, the tubular portion that is formed in the peripheral portion around the fitting hole is substantially flush with the flat portion of the pedal sheet. The tubular portion can be easily formed, for example, by burring hole process. The flat portion need not be completely flat as long as the flat portion is substantially flat as a whole. For example, the flat portion may be slightly curved, or the flat portion may be uneven.

As a method of welding the peripheral portion around the fitting hole formed in the pedal sheet and the sheet fixed portion of the pedal arm to each other, non-consumable electrode welding methods are suitably employed, such as plasma welding and TIG welding, or welding methods such as laser welding and electron beam welding, in which only base materials (the pedal sheet and the pedal arm) are melted and welded together without using welding material. However, consumable electrode arc welding or a welding method in which, for example, a welding rod is used may be employed.

Hereafter, embodiments of the invention will be described in detail with reference to the accompanying drawings.

Figure 1C:
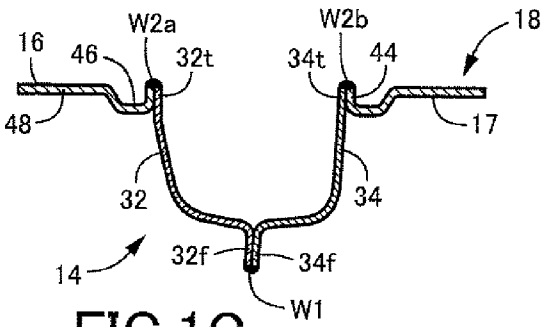
Figure 1A:
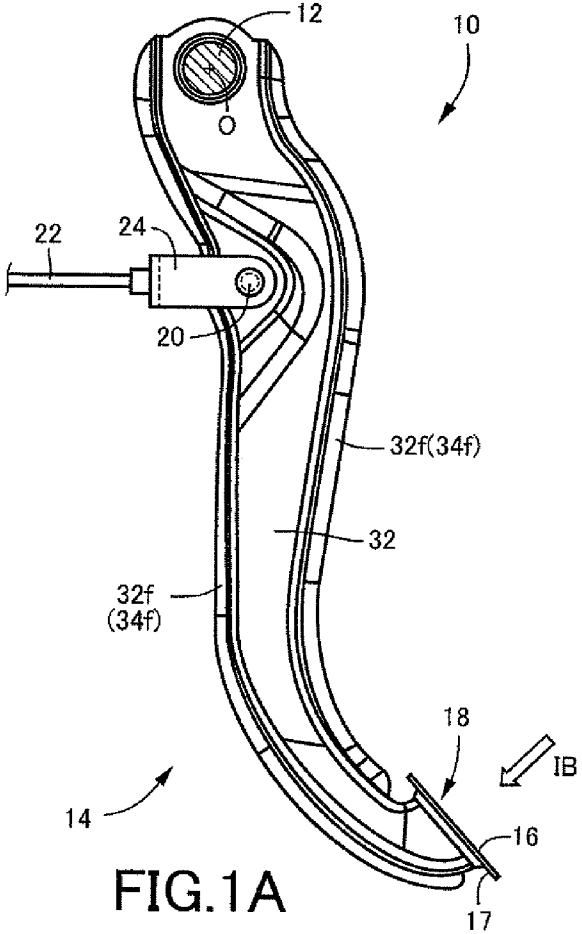
Figure 2:
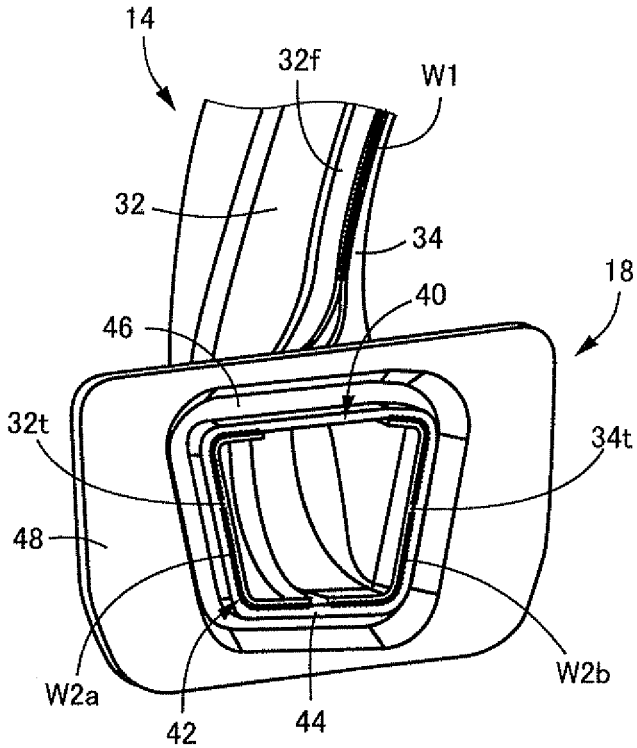
FIG. 2 is a perspective view showing the structure near the pedal sheet in the first embodiment shown in FIGS. 1A to 1C.

FIGS. 1A to 1C are views showing a brake pedal 10 for a vehicle service brake, to which the invention is applied. FIG. 1A is a left side view. FIG. 1B is an enlarged front view showing the structure near a pedal sheet 18 viewed from the direction indicated by an arrow IB in FIG. 1A. FIG. 1C is a cross-sectional view taken along the line IC-IC in FIG. 1B. FIG. 2 is a perspective view showing the structure near the pedal sheet 18. The brake pedal 10 is formed mainly of a pedal arm 14. The brake pedal 10 is supported at an upper end portion of the pedal arm 14 so as to be pivotable about a support axis O that is an axis of a support shaft 12 that extends substantially horizontally.

A lower end portion of the pedal arm 14 is bent obliquely upward toward a driver's seat, that is, toward the rear of a vehicle. The plate-shaped pedal sheet 18 is integrally fixed to the lower end portion of the pedal arm 14 in such a posture that a depressed face 16, on which a foot of the driver is placed, faces the driver's seat. When the pedal sheet 18 is depressed by the driver, the brake pedal 10 is pivoted about the support shaft 12 in the clockwise direction in FIG. 1A. A pushrod 22 of a brake master cylinder is connected to the brake pedal 10 via a clevis 24 so as to be pivotable, relative to the brake pedal 10, about an axis of a connection pin 20 that extends substantially parallel to the support shaft 12. When the brake pedal 10 pivots about the support shaft 12, the pushrod 22 is mechanically pushed leftward in FIG. 1A, whereby a brake hydraulic pressure is generated in accordance with a force with which the brake pedal 10 is depressed. The pushrod 22 is urged so as to be protruded from the brake master cylinder. When the depression of the pedal sheet 18 is cancelled, the brake pedal 10 is pivoted about the support shaft 12 in the counterclockwise direction by the urging force, and held at an original position shown in FIG. 1A.

The pedal arm 14 is made of thin plates, has a hollow structure, and has a substantially rectangular cross section. The pedal arm 14 is constructed of a pair of halves 32 and 34 having shapes obtained by dividing the pedal arm 14 in the lateral direction of the vehicle, that is, the vehicle width direction. Each of the halves 32 and 34 is formed by bending a steel plate by press working, and has a substantially hat-shaped cross section. The halves 32 and 34 are put together in such a posture that opening-side portions of the hat-shaped halves 32 and 34 face each other and in such a manner that plate-shaped peripheral flanges 32*f* and 34*f*, which are formed at the opening-side portions so as to extend outward and which extend parallel to each other, are brought into close contact with each other. In this state, outer edges of the peripheral flanges 32*f* and 34*f*, that is, edges that extend in the longitudinal direction of the vehicle and the vehicle height direction are integrally joined to each other with edge weld that is made by plasma welding. A first weld W1 indicates a weld at which the peripheral flanges 32*f* and 34*f* are welded to each other.

The pedal sheet 18 is formed of a metal plate member, for example, a steel plate, and has a laterally-long substantially rectangular shape. A single fitting hole 40, through which the lower end portion of the pedal arm 14, that is, a sheet fixed portion extends, is formed in a center portion of the pedal sheet 18. The lower end portion of the pedal arm 14 opens toward a driver's seat, and upper portions of the pair of halves 32 and 34 extend gradually apart from each other in the lateral direction toward an end opening portion 42 of the lower end portion of the pedal arm 14 so that the lower end portion of the pedal arm 14 has a skirt shape, that is, the cross section of the lower end portion gradually increases. Therefore, the end opening portion 42 shown in FIG. 1B has a substantially trapezoidal shape having an upper side that is longer than a lower side. A pair of projections 32*t* and 34*t* is integrally formed with the end opening portion 42. The projections 32*t* and 34*t* project continuously from the end opening portion 42, at portions which is formed in a U-shape so as to extend along the upper side and the lower side from corresponding one of right and left oblique sides of the trapezoidal shape. The projection 32*t* is formed in the half 32, and the projection 34*t* is formed in the half 34. The fitting hole 40 has a trapezoidal shape that corresponds to the end opening portion 42 of the lower end portion of the pedal arm 14. The pair of projections 32*t* and 34*t* is fitted into the fitting hole 40 from the rear face 17-side of the pedal sheet 18, that is, from the opposite side of the depressed face 16, while substantially closely contacting a portion of the pedal sheet 18 which is around the fitting hole 40 and which defines the fitting hole 40 (hereinafter, this portion will be referred to as "peripheral portion around the fitting hole 40"). The end opening portion 42 may correspond to the sheet fixed portion to which the pedal sheet 18 is integrally fixed.

A short tubular portion 44 that extends at substantially right angle to the depressed face 16 is formed in the peripheral portion around the fitting hole 40 by, for example, a burring hole process. The tubular portion 44 is formed along the entire circumference of the fitting hole 40. The tubular portion 44 is overlapped with outer peripheral faces of the pair of projections 32*t* and 34*t* formed at the end opening portion 42 of the pedal arm 14 so as to be closely contact the outer peripheral faces and so as to extend parallel to the outer peripheral faces. An edge of the tubular portion 44 is substantially flush with edges of the projections 32*t* and 34*t*, and the edge of the tubular portion 44 and the edges of the projections 32*t* and 34*t* are fixed integrally to each other with edge weld by plasma welding performed from the depressed face 16-side of the pedal sheet 18. Second welds W2*a* and W2*h* indicate welds at which the tubular portion 44 and the projections 32*t* and 34*t* are welded to each other. The U-shaped projections 32*t* and 34*t* are welded along their entire lengths to the tubular portion 44. That is, all of the four corner portions of the trapezoidal end opening portion 42 are integrally fixed to the pedal sheet 18.

As is clear from FIG. 1C, a groove 46 and a flat portion 48 are formed in the pedal sheet 18. The groove 46 recessed toward the rear face 17-side is formed annularly around the tubular portion 44. The flat portion 48 is contiguous with an outer peripheral-side side wall of the groove 46 and extends toward the outer periphery of the pedal sheet 18. The flat portion 48 is formed so as to be substantially flush with the edge of the tubular portion 44. In the drawings, the flat portion 48 is indicated as a completely flat plate. Alternatively, an upper end and a lower end of the flat portion 48 may be slightly curved toward the rear face 17-side, the flat portion 48 may be uneven so that a grip is given to the flat portion 48.

In the brake pedal 10 according to the first embodiment, the fitting hole 40, through which the end opening portion 42 of the lower end portion of the pedal arm 14 extends, is formed in the pedal sheet 18. In addition, the end opening portion 42 of the pedal arm 14 is fitted in the fitting hole 40 from the rear face 17-side, and then the peripheral portion around the fitting hole 40 is integrally fixed to the end opening portion 42 of the pedal arm 14 by plasma welding performed from the depressed face 16-side. Accordingly, there is no possibility that a welding device, for example, a welding torch and the pedal arm 14 contact each other when welding is performed, which increases the flexibility in handling of the welding device. As a result, it is possible to more easily achieve a predetermined degree of depression rigidity by appropriately setting the welds. In the first embodiment, the U-shaped projections 32*t* and 34*t* that include the four corner portions of the trapezoidal end opening portion 42 are formed, and these projections 32*t* and 34*t* are integrally fixed along their entire lengths to the pedal sheet 18. Therefore, it is possible to easily achieve a high degree of depression rigidity due to the rigidity of the corner portions.

In the first embodiment, the short tubular portion 44 is formed in the peripheral portion around the fitting hole 40, and the edge of the tubular portion 44 and the edge of the end opening portion 42 of the lower end portion of the pedal arm 14, that is, the edges of the projections 32*t* and 34*t* are substantially flush with each other. Then, the edge of the tubular portion 44 and the edges of the projections 32*t* and 34*t* are integrally fixed to each other with edge weld. Therefore, the flexibilities in handling of the welding device and setting the welds are made higher than those in, for example, fillet weld. In this case, the groove 46 and the flat portion 48 are formed in the pedal sheet 18. The groove 46 is formed around and along an outer periphery of the tubular portion 44, and the flat portion 48 is contiguous with the outer peripheral-side side wall of the groove 46 and extends toward the outer periphery of the pedal sheet 18. The flat portion 48 and the edge of the tubular portion 44 are substantially flush with each other. Therefore, a bulge of the weld of, for example, the tubular portion 44 is eliminated or reduced. As a result, it is possible to suppress deterioration of an operating feel felt by the driver who places his/her foot on the depressed face 16 and depresses the depressed face 16.

The tubular portion 44 that extends at substantially right angle to the depressed face 16 is formed in the peripheral portion around the fitting hole 40. Due to the presence of the tubular portion 44, it is possible to easily fit the end opening portion 42 of the lower end portion of the pedal arm 14 into the fitting hole 40 from the rear face 17-side of the pedal sheet 18, more specifically, it is possible to easily fit the pair of projections 32*t* and 34*t* into the tubular portion 44. Further it is possible to reduce the amount of play between the pedal arm 14 and the pedal sheet 18. Thus, it is possible to improve the workability when the pedal arm 14 and the pedal sheet 18 are fitted together to perform welding, and to easily achieve a high degree of welding rigidity because the play between the pedal arm 14 and the pedal sheet 18 is reduced.

Next, a second embodiment of the invention will be described. In the second embodiment, the portions that are substantially the same as those in the first embodiment will be denoted by the same reference numerals as those in the first embodiment, and the detailed description thereof will be omitted.

Figure 3A:
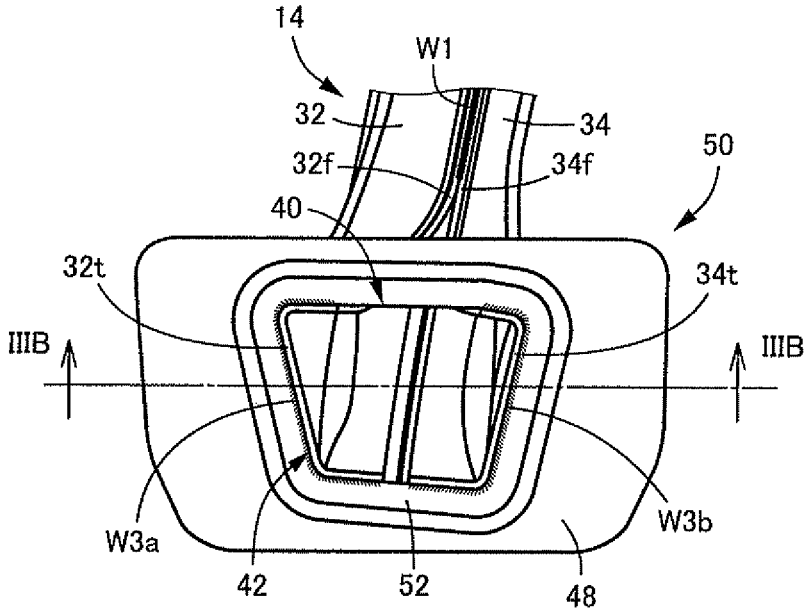
FIGS. 3A and 3B are views showing a second embodiment of the invention, and correspond to FIGS. 1B and 1C, respectively.
Figure 3B:
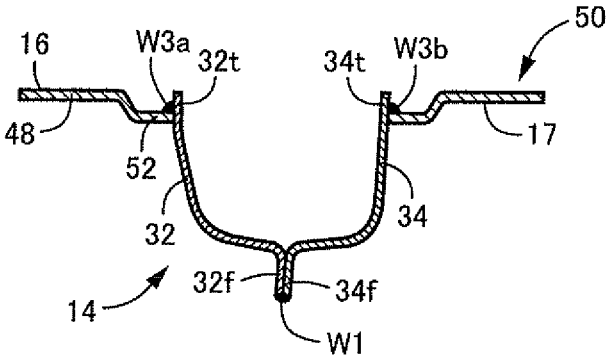

In a pedal sheet 50 according to the second embodiment shown in FIG. 3, the tubular portion 44 is not formed in the peripheral portion around the fitting hole 40, and the projections 32*t* and 34*t* are fitted in the fitting hole 40 in such a manner that an inner peripheral step portion 52 that corresponds to a bottom of the groove 46 contacts the outer peripheral faces of the projections 32*t* and 34 at substantially right angle. In addition, the inner peripheral step portion 52 and the projections 32*t* and 34*t* are fixed integrally with each other with fillet weld by arc welding or the like performed from the depressed face 16-side. Third welds W3*a* and W3*b* indicate welds at which the inner peripheral step portion 52 and the projections 32*t* and 34*t* are welded to each other. The U-shaped projections 32*t* and 34*t* are welded along their entire lengths to the inner peripheral step portion 52. FIGS. 3A and 3B correspond to FIGS. 1B and 1C, respectively. FIG. 3B is a cross-sectional view taken along the line IIIB-IIIB in FIG. 3A.

In the second embodiment as well, the peripheral portion around the fitting hole 40 is integrally fixed to the end opening portion 42 of the lower end portion of the pedal arm 14, for example, by arc welding performed from the depressed face 16-side. Therefore, there is no possibility that the welding device, for example, the welding torch and the pedal arm 14 contact each other when the welding is performed. Accordingly, it is possible to produce the same effects as those in the first embodiment, for example, it is possible to increase the flexibility in handling of the welding device, and to easily achieve a predetermined degree of depression rigidity by appropriately setting welds.

Figure 4A:
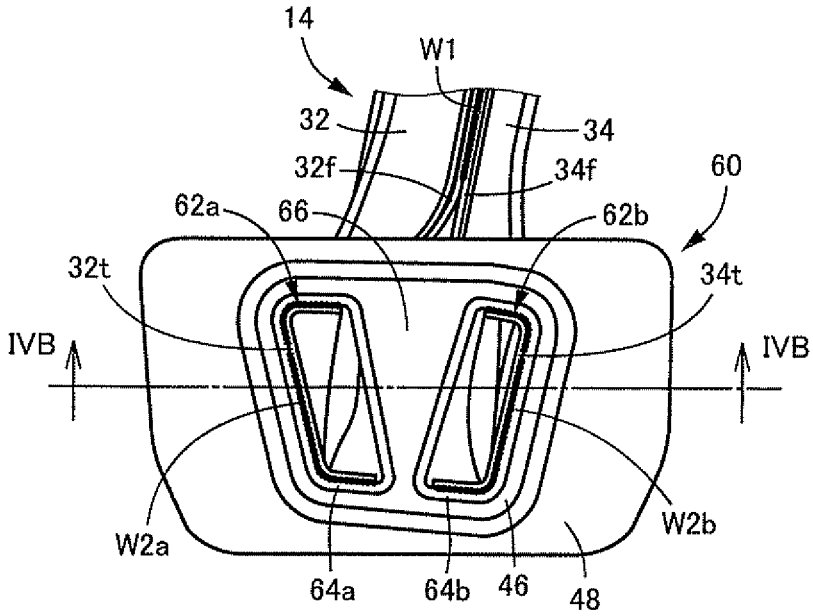
Figure 4B:
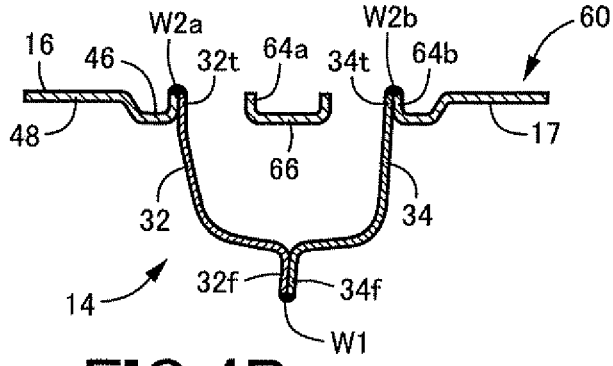

The fitting hole 40 may be formed in a center portion of the pedal sheet 50 that is formed only of the flat portion 48 and that does not have the inner peripheral step portion 52. Then, the end opening portion 42 of the lower end portion of the pedal arm 14, that is, the pair of projections 32*t* and 34*t* may be fitted in the fitting hole 40 in such a manner that the depressed face 16 of the pedal sheet 50 is substantially flush with the edge of the end opening portion 42, that is, the edges of the pair of projections 32*t* and 34*t*. Then, the outer peripheral portion around the fitting hole 40 and the projections 32*t* and 34*t* may be integrally welded to each other Next, a third embodiment of the invention will be described. In a pedal sheet 60 according to the third embodiment in FIG. 4, a pair of fitting holes 62*a* and 62*b* that correspond to the pair of projections 32*t* and 34*t* is formed. The fitting holes 62*a* and 62*b* have shapes obtained by partitioning the fitting hole 40 in the first embodiment into two holes. Short tubular portions 64*a* and 64*b*, each of which is similar to the tubular portion 44, are formed in peripheral portions around the fitting holes 62*a* and 62*b*, respectively. Edges of the tubular portions 64*a* and 64*b* and the edges of projections 32*t* and 34*t* are made substantially flush with each other, and integrally fixed to each other with edge weld by plasma welding. FIGS. 4A and 4B correspond to FIGS. 1B and 1C, respectively. FIG. 4B is a cross-sectional view taken along the line IVB-IVB in FIG. 4A.

In the third embodiment as well, it is possible to produce the same effects as those in the first embodiment. In addition, in the third embodiment, the paired fitting holes 62*a* and 62*b* are formed separately for the paired projections 32*t* and 34*t*, respectively, an intermediate connection portion 66 that is continuous with the groove 46 is present between the fitting holes 62*a* and 62*b*, and the annular tubular portions 64*a* and 64*b* are formed in the peripheral portions around the fitting holes 62*a* and 62*b*, respectively. Therefore, the rigidity of the pedal sheet 60 itself is increased. In addition, the total area of the fitting holes 62*a* and 62*b* formed in the pedal sheet 60 is smaller than the area of the fitting hole 40, and the fitting holes 62*a* and 62*b* are separated from each other. Therefore, in cooperation with an increase in the rigidity of the pedal sheet 60, a depressing operation feel is improved.

The embodiments of the invention have been described in detail with reference to the accompanying drawings. However, the invention is not limited to the above-described embodiments, and may be implemented in various other embodiments that are achieved by making various modifications and improvements to the above-described embodiments based on the knowledge of persons skilled in the art.

What is claimed is:

1. A vehicle operation pedal in which a pedal sheet is integrally fixed to a sheet fixed portion of a pedal arm in such a posture that a depressed face of the pedal sheet, which is depressed by a driver, faces a driver's seat, comprising:

a fitting hole through which the sheet fixed portion of the pedal arm extends formed in the pedal sheet;

the sheet fixed portion being fitted into the fitting hole from a rear face that is on the side opposite to the depressed face;

a tubular portion that extends toward a depressed face side across a groove at a substantially right angle to the depressed face so as to be overlapped with an outer peripheral face of the sheet fixed portion and so as to be parallel to the outer peripheral face being formed in an inner distal end of the fitting hole, and a distal end of the tubular portion and a distal end of the sheet fixed portion being made substantially flush with each other, being fusion-welded to each other at the depressed face side and being integrally fixed to each other; and the groove and a flat portion being formed in the pedal sheet, the groove being extended around and along an outer periphery of the tubular portion and being recessed toward a rear face side, and the flat portion being contiguous with an outer peripheral-side side wall of the groove and being extended toward an outer periphery of the pedal sheet.

2. The vehicle operation pedal according to claim 1, wherein the pedal arm has a hollow structure and has a cross section in a polygonal shape, and an end opening portion of a lower end portion of the pedal arm is used as the sheet fixed portion; and a distal end of the end opening portion and the inner distal end of the fitting hole are fusion-welded and integrally fixed to each other in such a manner that at least one of corner portions of the polygonal shape is included in a weld at which the distal end of the end opening portion and the inner distal end of the fitting hole are fusion-welded to each other.

* * * * *